US008590452B2

(12) United States Patent
Tiainen et al.

(10) Patent No.: US 8,590,452 B2
(45) Date of Patent: Nov. 26, 2013

(54) ARRANGEMENT FOR SUPPORTING SHELL INTO WEAPON BARREL, SUPPORT ELEMENT AND METHOD

(75) Inventors: Jukka Tiainen, Sastamala (FI); Mika Nurminen, Nokia (FI); Seppo Hakari, Tampere (FI)

(73) Assignee: Patria Land Systems Oy, Helsinki (FI)

( * ) Notice: Subject to any disclaimer, the term of this patent is extended or adjusted under 35 U.S.C. 154(b) by 204 days.

(21) Appl. No.: 12/865,421

(22) PCT Filed: Jan. 30, 2009

(86) PCT No.: PCT/FI2009/050078

§ 371 (c)(1),
(2), (4) Date: Jul. 30, 2010

(87) PCT Pub. No.: WO2009/095540

PCT Pub. Date: Aug. 6, 2009

(65) Prior Publication Data

US 2010/0326310 A1 Dec. 30, 2010

(30) Foreign Application Priority Data

Jan. 31, 2008 (FI) ..... 20085078

(51) Int. Cl.
*F42B 30/10* (2006.01)

(52) U.S. Cl.
USPC ..... 102/446; 102/520

(58) Field of Classification Search
USPC ..... 102/445, 446, 473, 293, 520, 469, 483
See application file for complete search history.

(56) References Cited

U.S. PATENT DOCUMENTS

| | | | | | |
|---|---|---|---|---|---|
| 3,182,595 | A | * | 5/1965 | Hassmann | 102/202 |
| 3,948,179 | A | * | 4/1976 | Gawlick et al. | 102/529 |
| 4,444,115 | A | | 4/1984 | Romer et al. | |
| 4,763,577 | A | * | 8/1988 | Romer et al. | 102/431 |
| 4,770,099 | A | * | 9/1988 | Brede et al. | 102/472 |
| 4,803,927 | A | * | 2/1989 | Washburn | 102/434 |
| 4,938,146 | A | * | 7/1990 | Gunther et al. | 102/439 |
| 5,335,600 | A | * | 8/1994 | Horr et al. | 102/470 |

(Continued)

FOREIGN PATENT DOCUMENTS

| | | | |
|---|---|---|---|
| CN | 1269008 | A | 10/2000 |
| EP | 1712873 | A1 | 10/2006 |
| WO | WO 93/07439 | A2 | 4/1993 |

*Primary Examiner* — Benjamin P Lee
(74) *Attorney, Agent, or Firm* — Birch, Stewart, Kolasch & Birch, LLP

(57) ABSTRACT

The invention relates to an arrangement for supporting a shell (1), such as a mortar shell, into the barrel of a breech-loading weapon, the arrangement comprising a support element (8) to be fastened to the tail of the mortar shell, the element comprising a rim flange (87), means for fastening the support element to the tail of the mortar shell (1), and firing means (9) for firing an actual primer (5) of the mortar shell (1) for firing the mortar shell. The arrangement is characterized in that the means for fastening the support element to the shell tail are arranged in the support element (8) by means of finger-like fastening members (80) settling onto the shell tail tube (3) and arranged to constitute an interference fit between the shell (1) and the support element (8) when the shell (1) is placed in the support element (8). The invention also relates to a support element and a method for supporting a mortar shell (1) into the barrel of a breechloading weapon.

20 Claims, 7 Drawing Sheets

(56) References Cited

U.S. PATENT DOCUMENTS

| | | | | |
|---|---|---|---|---|
| 5,463,958 | A * | 11/1995 | Roheim | 102/445 |
| 5,503,080 | A | 4/1996 | Goward et al. | |
| 6,257,148 | B1 | 7/2001 | Toivonen et al. | |
| 6,772,693 | B2 * | 8/2004 | Kuru et al. | 102/293 |
| 2004/0107857 | A1 * | 6/2004 | Kuru et al. | 102/293 |
| 2010/0269722 | A1 * | 10/2010 | Niemi et al. | 102/293 |
| 2010/0282114 | A1 * | 11/2010 | Reunamaki | 102/473 |
| 2010/0288112 | A1 * | 11/2010 | Reunamaki et al. | 89/27.13 |
| 2010/0288150 | A1 * | 11/2010 | Kautto et al. | 102/293 |
| 2010/0288153 | A1 * | 11/2010 | Reunamaki et al. | 102/473 |
| 2010/0300321 | A1 * | 12/2010 | Johansson | 102/481 |
| 2010/0326310 | A1 * | 12/2010 | Tiainen et al. | 102/473 |

* cited by examiner

ARRANGEMENT FOR SUPPORTING SHELL INTO WEAPON BARREL, SUPPORT ELEMENT AND METHOD

FIELD OF THE INVENTION

The invention relates to an arrangement for supporting a shell, such as a mortar shell, into the barrel of a breech-loading weapon, the arrangement comprising a support element to be fastened to a mortar shell tail, the element comprising a rear part provided with a rim flange and means for fastening the support element to the mortar shell tail, and a firing member in the support element for firing the actual primer of the mortar shell for firing the mortar shell.

The invention further relates to a support element to be fastened to a shell and a method of supporting a shell into the barrel of a breech-loading weapon, comprising a rear part provided with a rim flange and means for fastening the support element to a mortar shell tail, and a firing member in the support element for firing the actual primer of a shell, such as a mortar shell, for firing the mortar shell.

BACKGROUND OF THE INVENTION

Mortars are nowadays mounted on movable bases, allowing them to be moved from one place to another and, correspondingly, allowing them to be rapidly moved from the emplacement. A problem in such solutions is the ability of said base, i.e. vehicle, to defend itself against possible attacks, and the use thereof for destroying close-range targets on the ground. A moving base provided with a heavy shell mortar is normally unable to carry heavy defensive facilities in addition to the shell mortar, instead, it is at most provided with a heavy machine gun or corresponding lighter armature. In such a situation, the vehicle needs to be able to use the shell mortar for also firing horizontally or below it, for which normal mortar shells and shell mortars are not suited. A mortar shell inside a normal shell mortar having a smooth barrel is able to move when the shell mortar is oriented in the horizontal direction or below it in the barrel in such a manner that it either falls from the barrel or moves to such an extent that the mortar shell does not go off.

This problem is solved in the solution according to WO application FI 98/00064, wherein a separate control piece and a locking piece are attached to the tail of a conventional mortar shell with a mechanical locking. The locking piece fractures in connection with the firing. In this solution, separate parts have to be added in between the mortar shell and the control piece, which complicate the fastening of the control piece.

BRIEF DESCRIPTION OF THE INVENTION

An object of the present invention is to provide a new and improved arrangement, support element and method so as to make a shell of a mortar stay at the right position in the barrel of a breech-leading mortar with a sufficient certainty and operate reliably and safely in all situations.

The arrangement of the invention is characterized in that the means for fastening the support element to the shell tail tube are arranged in the support element by means of fastening members settling onto the tail tube of the mortar shell and arranged to constitute an interference fit between the mortar shell and the support element.

The support element of the invention is characterized in that the means for fastening the support element to the tail of the shell are arranged in the support element by means of fastening members settling onto the tail tube of the mortar shell and arranged to constitute an interference fit between the mortar shell and the support element.

The method of the invention is characterized by using a support element in the fastening, wherein means for fastening the support element to the tail of the shell are provided in the support element by means of fastening members settling onto the tail tube of the mortar shell and arranged to constitute an interference fit between the mortar shell and the support element when fastened to the tail of the mortar shell.

An idea of the invention is to lock a shell, such as a mortar shell, to a support element by an interference fit between the tail tube of the mortar shell and the support element. The interference fit is provided by means of fastening members that settle on top of the tail tube of the mortar shell. The fastening members are provided in the support element by milling, for example. An advantage of the invention is that no separate fragile parts are required for the fastening, but the mortar shell is released from the interference fit between the support element and the mortar shell during firing by force of the gunpowder gases.

The idea of an embodiment of the invention is that the dimensions and position of the fastening members that settle on top of the tail tube are determined according to the tail tube of the mortar shell to be placed therein in such a manner that the diameter of the circumference constituted by the inner surfaces of the fastening members is slightly smaller than the outer diameter of the tail tube of the mortar shell to be placed in the support element. The interference fit between the support element and the tail tube of the mortar shell is selected in such manner that the fastening is sufficient to operate at all temperatures and in all operating environments required. An advantage is that no separate parts are required for the fastening.

The essential idea of another embodiment of the invention is that the fastening members settling onto the tail tube are finger-like and extend on the tail tube into a space between the control fins.

The essential idea of a third embodiment of the invention is that the surface of the fastening member of the support element settling onto the shell tail tube is provided with rifles or other corresponding projections that are pressed against the shell tail tube in the interference fit between the shell and the support element. The rifles or projections may also be provided in the shell tail part, on the outer surface of the fastening piece of the primer placed in the shell tail tube, for example. An advantage is that no separate parts are required for the fastening and the shaping of the opposite parts may be used to add the friction between the parts in the interference fit.

The essential idea of a fourth embodiment of the invention is that the fastening member has a fastening opening provided with a threading, to which a screw-like fastening means can be placed. The fastening means may be screwed through the fastening opening against the shell tail tube. The fastening opening is provided in the finger-like fastening member in a direction deviating from a direction perpendicular relative to the axial direction of the shell in a manner allowing the screw-like fastening means to be placed in the fastening opening when the shell is placed in the support element. The direction of the fastening opening deviates from a direction perpendicular relative to the axial direction of the shell preferably by 20 to 80 degrees and more preferably 30 to 70 degrees. In practice, the length of the rim jacket determines the angle of the fastening opening. In practice, the angle should be set such that the screw can be tightened fixed when the shell is placed inside the support element. The fastening openings may be provided in one or more finger-like fastening members extending upwards from the bottom of the support element. An advantage is that the friction between the parts can be increased in the interference fit.

The essential idea of a fifth embodiment of the invention is that finger-like fastening members are provided in the support element numerically such that during fastening, instead of one fastening member, two finger-like fastening members extend between two adjacent control fins of the shell.

BRIEF DESCRIPTION OF THE FIGURES

In the following, the invention will be described in more detail in connection with preferred embodiments with reference to the accompanying drawings, in which FIG. 1*a* schematically shows a shell supported into a weapon barrel by means of the arrangement of the invention.

In the figures, some embodiments of the invention are shown in a simplified manner for the sake of clarity. In the figures, like parts are denoted with like reference numerals.

DETAILED DESCRIPTION OF THE INVENTION

Figure 1A:
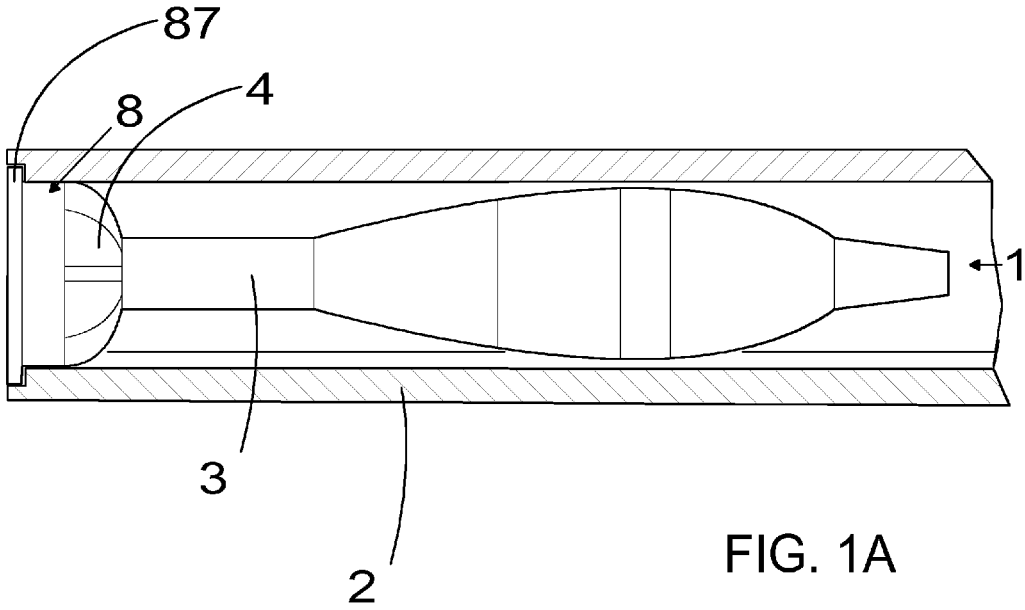
FIG. 1*b* shows a back view of the arrangement of FIG. 1*a*, FIG. 2 schematically shows a back view in partial section of a support element of the invention fastened to a shell, FIG. 3 schematically shows a side view in partial section of a shell fastened to a support element of the invention, FIG. 4 schematically shows a side view in partial section of a shell fastened to another support element of the invention, FIG. 5 schematically shows a side view in partial section of a shell fastened to another support element of the invention, FIG. 6 schematically shows a side view in partial section of a shell fastened to another support element of the invention, FIG. 7 schematically shows a side view in partial section of a shell fastened to the support element shown in FIG. 6, FIG. 8 schematically shows a back view in partial section of a support element according to another embodiment of the invention fastened to a shell, and FIG. 9 schematically shows a side view in partial section of a shell fastened in the manner according to FIG. 8.

In FIG. 1*a*, a shell 1 is arranged in a breech-loading weapon barrel 2. The weapon may be a shell mortar having a substantially smooth inner surface of the barrel 2. The rear part of the shell 1 comprises a tail tube 3 and a tail. The tail comprises one or typically a plurality of control fins 4 for affecting the trajectory of the shell 1. The details of the structure of the shell 1 may deviate from the structure shown in the figure. For the sake of clarity, the lock of the weapon and the other details thereof are not shown. A support element 8 according to the invention is fastened to the tail for keeping the shell 1 in position in the barrel 2 until it is fired. A rim flange 87 in the support element 8 prevents the shell 1 from shifting forward in the barrel 2 when the barrel 2 is oriented horizontally or even if the barrel 2 pointed downward. Furthermore, the back surface of the weapon barrel may be provided with a groove or a recess into which the rim flange 87 belonging to the support element 8 may settle when the shell 1 provided with the support element 8 is loaded into the barrel. The support element 8 is dimensioned to endure, not only the load caused by the mass of the shell 1, but also any forces caused by vibration and accelerations.

Figure 1B:
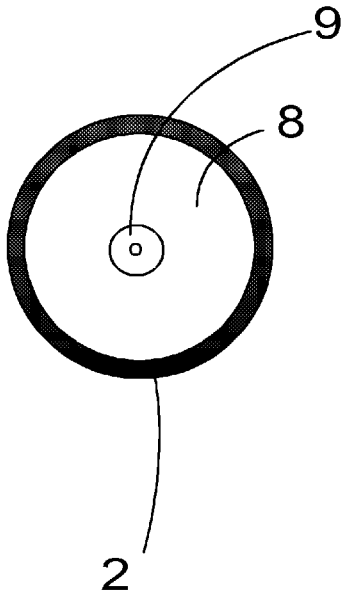

FIG. 1*b* shows a back view of the support element 8 arranged in the barrel of the weapon according to FIG. 1*a*. In the middle of the support element 8 is a firing member 9 for firing the actual primer of the shell.

In the following, the structure of the arrangement and the support element of the invention will be described with reference to FIGS. 2 to 9.

Figure 2:
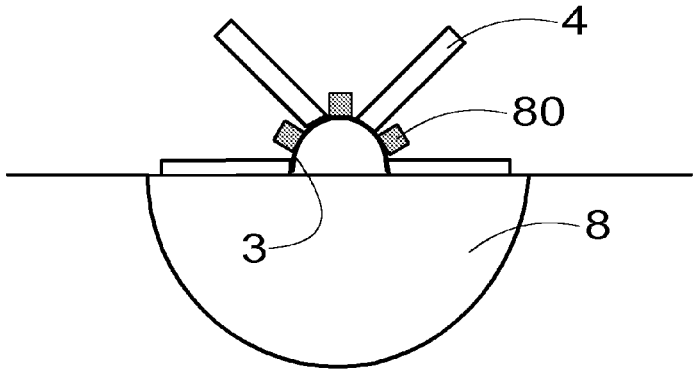

FIG. 2 schematically shows a back view in partial section of a support element of the invention fastened to a shell, wherein finger-like fastening members 80 are arranged in the middle of the support element 8. The inner shape of the support element may be implemented for instance by first lathing a projection extending upward from the end of the support element, to which projection is then milled a grid up to the surface of the intermediate firing pin. In this way, four upward extending finger-like fastening members are provided in the middle of the support element, which, upon fastening, settle onto the outer surface of the shell tail tube 3 between the control fins 4. The number of fastening members 80 may be varied. It is feasible that two fastening members 80 are arranged between each control fin 4. In addition, the fastening may be implemented by arranging a fastening member 80 only between some control fins.

Figure 3:
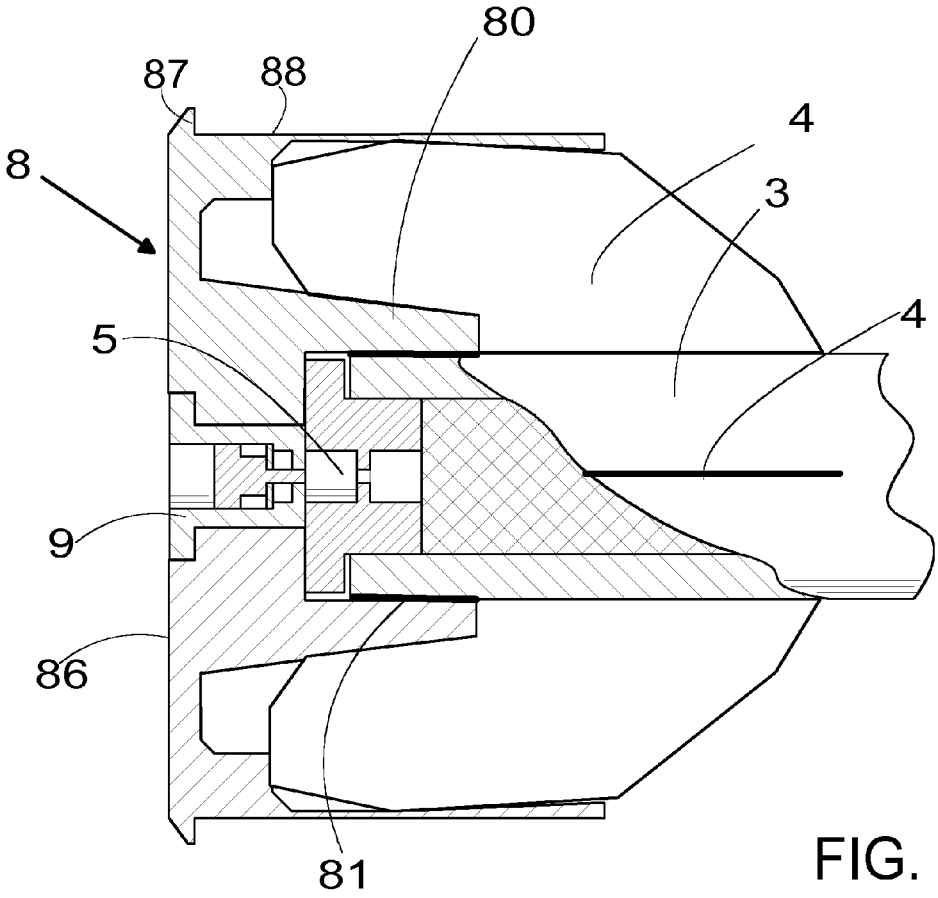

FIG. 3 schematically shows a shell fastened to a support element. The support element 8 comprises an end 86, a rim jacket 88 and a rim flange 87. The rim flange 88 in the support element 8 is dimensioned in such a manner that at least part of the shell tail is able to settle therein. In addition, in the middle of the support element 8 are firing means 9 for firing the actual primer 5 of the shell.

In the middle of the support element are finger-like fastening members 80 extending from the upper surface of the firing means 9 in the direction of the shell in such a manner that they settle onto the tail tube 3 between the shell control fins 4. A fastening surface 81 of the fastening members 80 is a surface settling against the shell tail tube. The distance between the fastening surfaces is dimensioned according to the diameter of the tail tube of the shell to be placed in said support element in such a manner that, during fastening of the shell to the support element 8, a tight fit is created between the fastening members 80 and the tail tube.

Figure 4:
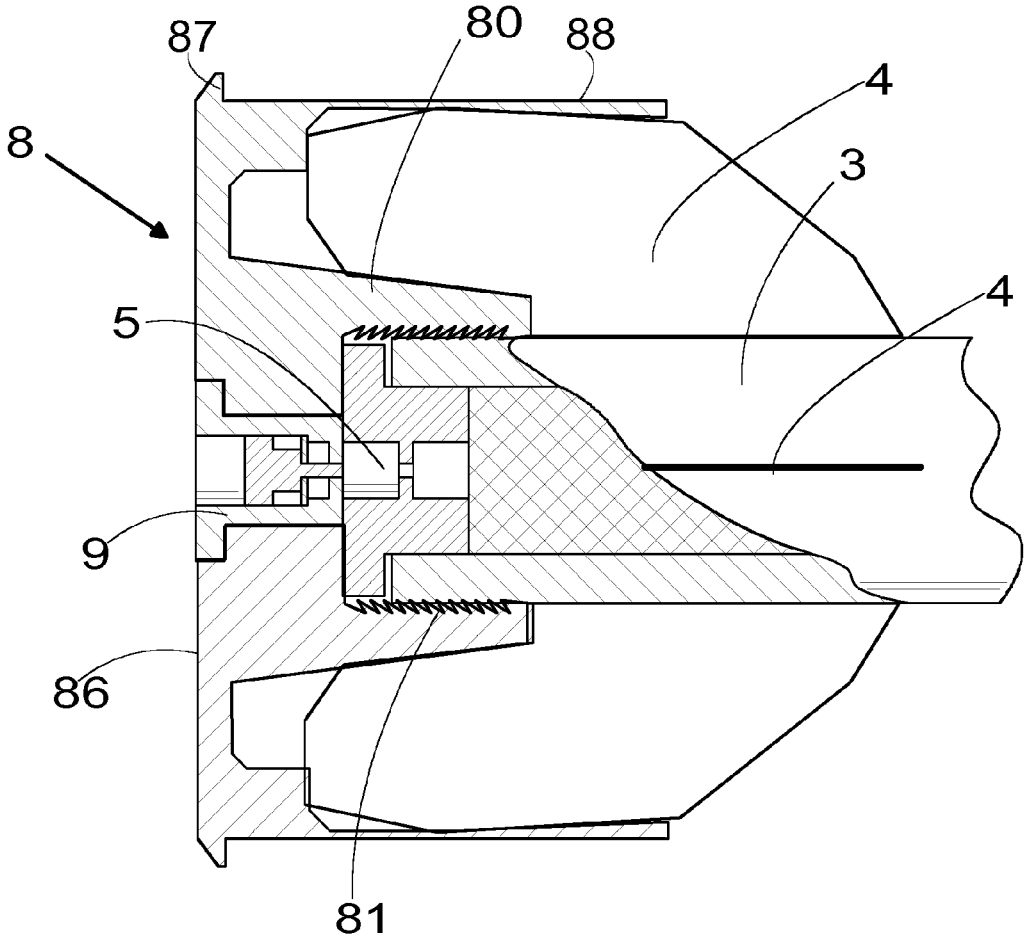

FIG. 4 shows a shell fastened to another support element 8 according to the invention. Here, a pattern, a sharp-pointed toothing, is machined in the fastening surface 81 of the fastening members 80, the toothing enhancing the interference fit between the shell tail tube 3 and the support element in such a manner that the friction in the fitting is larger when the parts are attempted to be withdrawn from each other than when the parts are moved towards each other. The fastening surface 81 of the fastening members 80 may also comprise a coarse toothing, rifles or other corresponding projections that are pressed against the tail tube 3 during the fastening.

Figure 5:
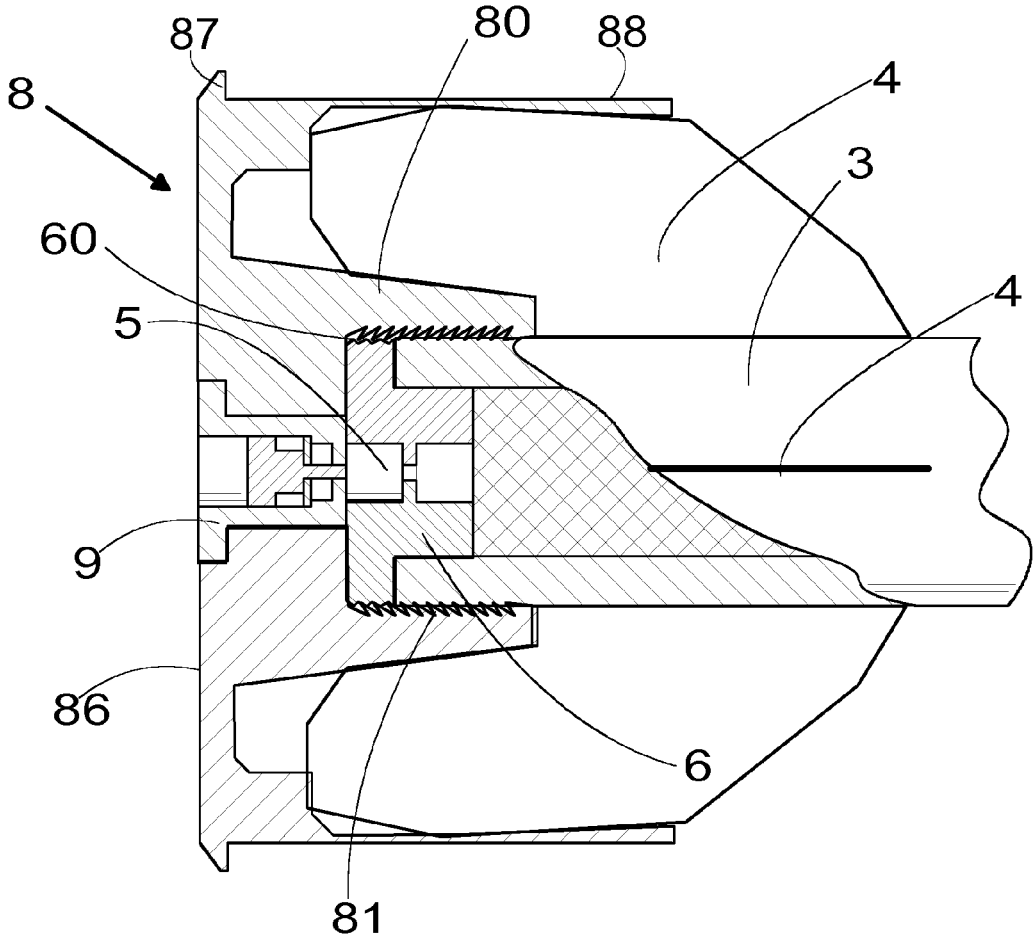

FIG. 5 shows a shell fastened to the support element 8 shown in FIG. 4. In this embodiment, rifles or other corresponding projections are arranged in the outer surface 60 of the fastening piece 6 of the primer placed in the shell tail tube 3. This being so, part of the shaping of the fastening surface of the fastening members 80 is pressed against the shell tail tube 3 and part of the shaping is pressed against the outer surface 60 of the fastening piece of the primer.

Figure 6:
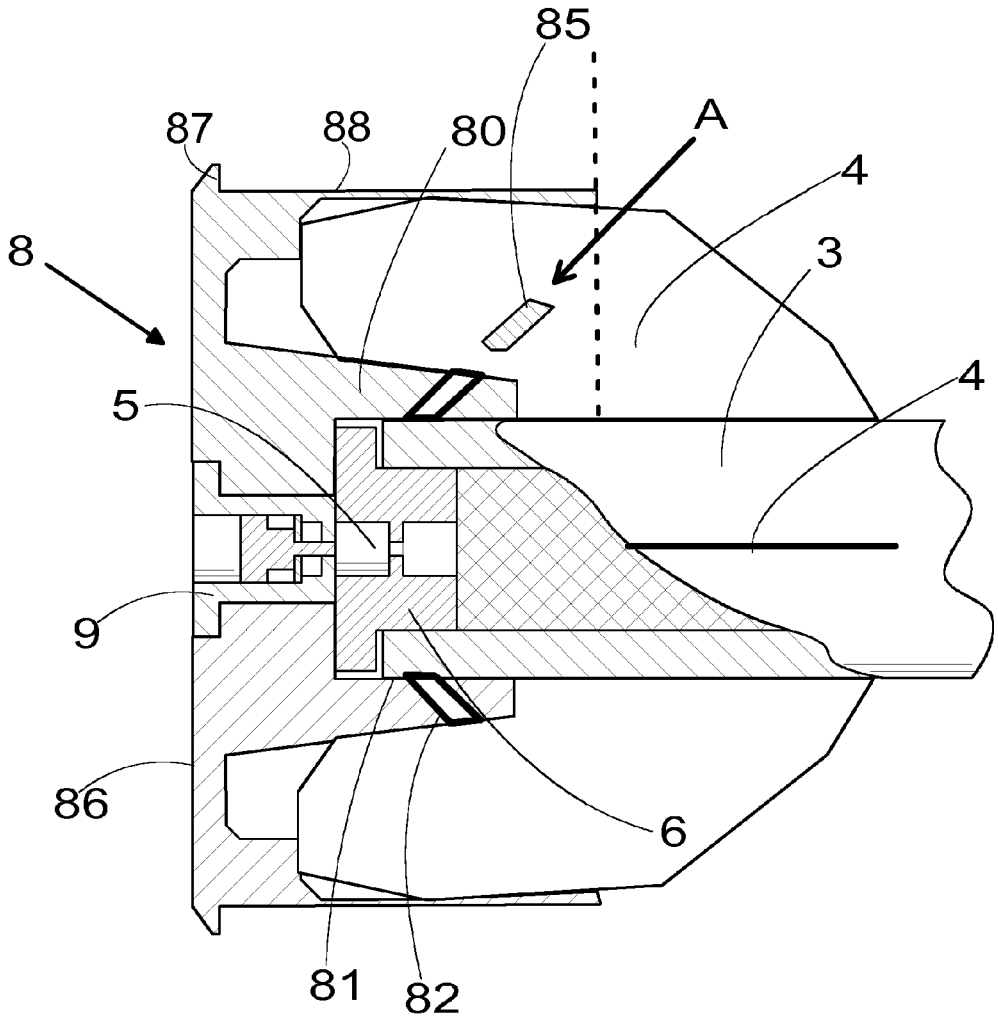
Figure 7:
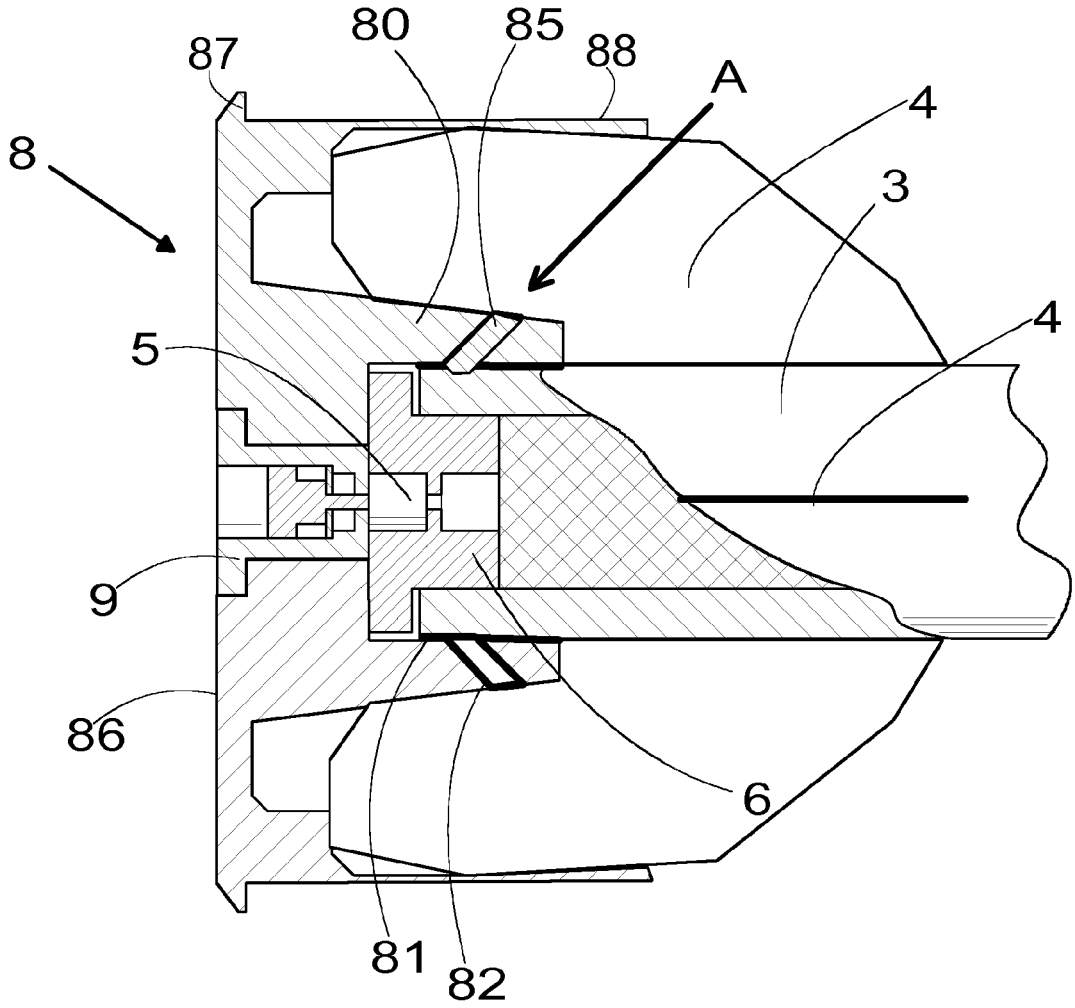

FIGS. 6 and 7 show an embodiment wherein the fastening members 80 have fastening openings 82, through which a screw-like fastening means 85 can be threaded against the shell tail tube 3.

The screw-like fastening means 85 may be for instance a retainer screw that can be threaded with a tool, such as an Allen wrench, to the shell tail tube 3. The retainer screw may be sharp-pointed, whereby the tips are pressed more easily to the tail tube. During firing, short tracks in the longitudinal direction of the tail tube are produced by the screw tips in the tail end of the tail tube. In the fastening opening, threads corresponding to the retainer screws used are threaded.

The fastening opening 82 is provided in the finger-like fastening member 80 in a direction deviating from a direction perpendicular relative to the axial direction of the shell (shown in the figure with reference marking A) in such a manner that the screw-like fastening means 85 may be placed in the fastening opening 82 when the shell 1 is placed in the support element 8. The direction of the fastening opening 82 deviates from a direction perpendicular to the axial direction of the shell 1 preferably by 20 to 80 degrees and more preferably 30 to 70 degrees. The angle being determined in a manner allowing the tool to be placed from the upper edge of the rim jacket 88 of the support member 8 towards the fastening opening 82. The screw-like fastening means 85 at the angle, such as retainer screws, press the tail against the support element 8 and the firing means 9. In such a support element, the machining time is slightly longer, but no separate breaking ring is required.

Figure 8:
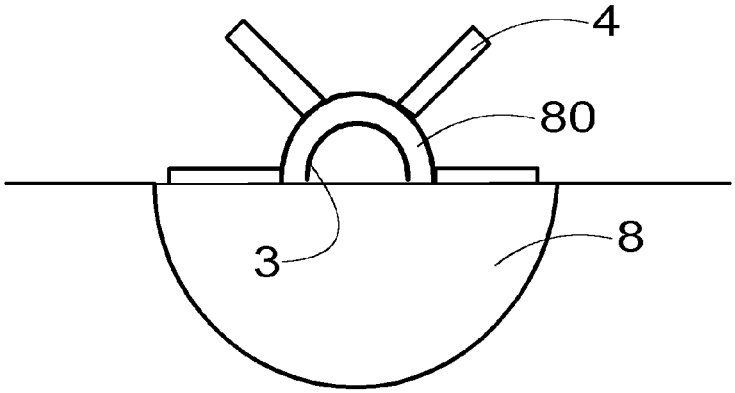

FIG. 8 schematically shows a back view in partial section of a support element of the invention fastened to a shell, wherein fastening members 80 are arranged in the middle of the support element 8 as a sleeve-like or cylindrical projection extending from the bottom of the support element towards the tail of the shell. The inner shape of the support element can be implemented for instance by first lathing a projection extending upward from the end of the support element, to which a space is then milled for receiving the shell tail. In this manner, the middle of the support element is provided with an upwardly extending fastening member that during fastening settles onto the outer surface of the shell tail tube 3.

Figure 9:
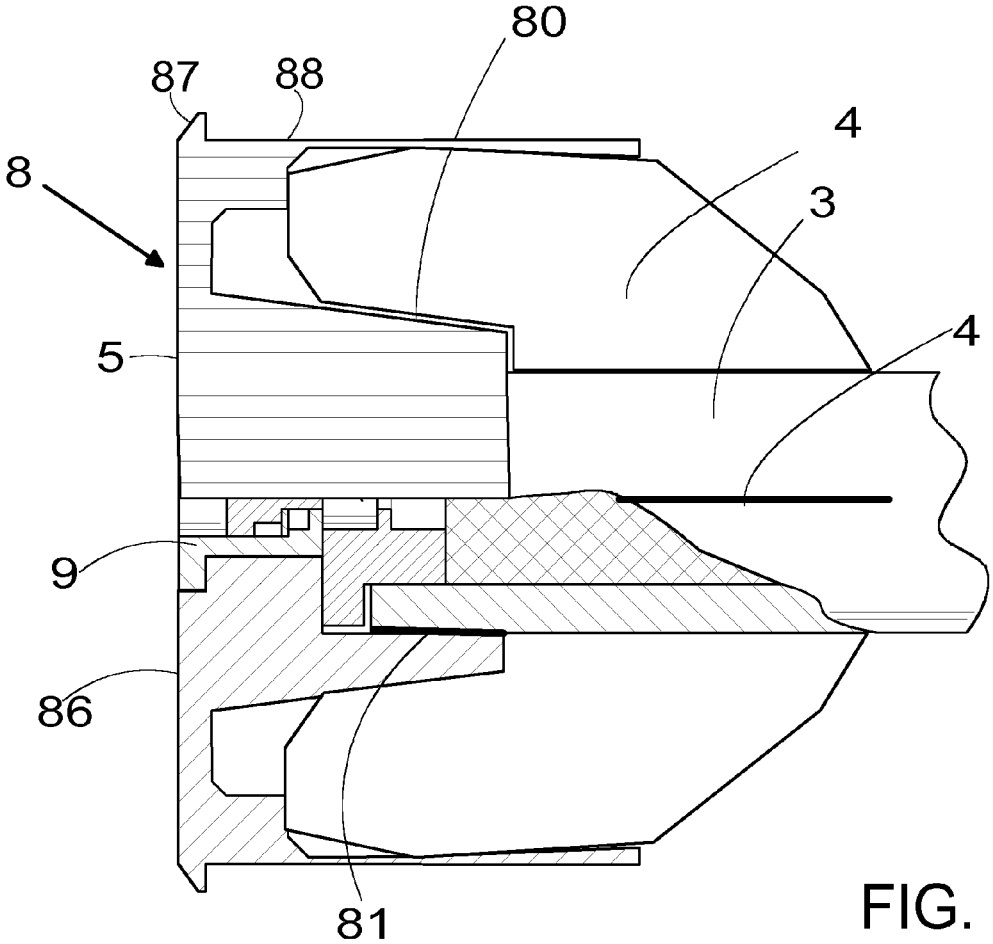

FIG. 9 schematically shows a shell fastened to a support element. The support element 8 comprises an end 86, a rim jacket 88 and a rim flange 87. The rim jacket 88 in the support element 8 is dimensioned in a manner allowing at least part of the shell tail to settle inside thereof. The middle of the support element 8 is further provided with firing means 9 for firing the actual primer 5 of the shell.

The middle of the support element is provided with fastening means 80 extending from the upper surface of the firing means 9 in the direction of the shell in such a manner that they settle onto the shell tail tube 3. The fastening surface 81 of the fastening members 80 is a surface settling against the shell tail tube. The inner circumference created in the fastening members 80 is dimensioned according to the outer circumference of the tail tube of the shell to be placed in said support element in such a manner that during the fastening of the shell to the support element 8, a tight fitting is created between the fastening member 80 and the tail tube. The figure illustrates that the rear part of the control fin 4 of the shell is shaped in a manner allowing the fastening members 80 to be fastened to the tail tube 3. This being so, the support element is fastened to the tail tube along the entire portion of the outer circumference thereof. It is to be noted that the solutions shown in FIGS. 4 to 7 may also be connected to the structures of the fastening members 80 of the support element 8 shown in FIGS. 8 and 9.

It is obvious to a person skilled in the art that as technology advances, the basic idea of the invention can be implemented in a variety of ways. Consequently, the invention and its embodiments are not restricted to the above examples, but may vary within the scope of the claims.

The invention claimed is:

1. An arrangement for supporting a shell into the barrel of a breech-loading weapon, the arrangement comprising a support element to be fastened to a shell tail, the element comprising a rim flange, means for fastening the support element to the tail of the shell, and firing means for firing an actual primer of the shell for firing the shell, wherein the means for fastening the support element to the shell tail tube are arranged in the support element by means of fastening members settling onto the shell tail tube and arranged to constitute an interference fit between the shell and the support element when the shell is placed in the support element.

2. An arrangement as claimed in claim 1, wherein the fastening member has a surface that settles onto the shell tail tube and is provided with rifles or other corresponding projections that settle against the shell tail tube in an interference fit between the shell and the support element.

3. An arrangement as claimed in claim 2, wherein an outer surface of a fastening piece of a primer placed in the shell tail tube is provided with rifles or other corresponding projections.

4. An arrangement as claimed in claim 3, wherein the fastening member has at least one fastening opening provided with a threading for placing a screw-like fastening means against the shell tail tube through said fastening opening.

5. An arrangement as claimed in claim 3, wherein the fastening members comprise at least two finger-like portions extending into a space between the control fins of the shell.

6. An arrangement as claimed in claim 2, wherein the fastening member has at least one fastening opening provided with a threading for placing a screw-like fastening means against the shell tail tube through said fastening opening.

7. An arrangement as claimed in claim 2, wherein the fastening members comprise at least two finger-like portions extending into a space between the control fins of the shell.

8. An arrangement as claimed in claim 1, wherein the fastening member has at least one fastening opening provided with a threading for placing a screw-like fastening means against the shell tail tube through said fastening opening.

9. An arrangement as claimed in claim 8, wherein the fastening opening is provided in the fastening member in a direction deviating from a direction perpendicular relative to the axial direction of the shell in a manner allowing the screw-like fastening means to be placed in the fastening opening when the shell is placed in the support element.

10. An arrangement as claimed in claim 9, wherein the direction of the fastening opening deviates from a direction perpendicular relative to the axial direction of the shell by 20 to 80 degrees.

11. An arrangement as claimed in claim 9, wherein the fastening members comprise at least two finger-like portions extending into a space between the control fins of the shell.

12. An arrangement as claimed in claim 11, wherein the support element is provided with finger-like fastening members numerically in such a manner than during fastening, two finger-like fastening members extend between two adjacent control fins of the shell.

13. An arrangement as claimed in claim 9, wherein the fastening members comprise at least two finger-like portions extending into a space between the control fins of the shell.

14. An arrangement as claimed in claim 8, wherein the fastening members comprise at least two finger-like portions extending into a space between the control fins of the shell.

15. An arrangement as claimed in claim 14, wherein the support element is provided with finger-like fastening members numerically in such a manner than during fastening, two finger-like fastening members extend between two adjacent control fins of the shell.

16. An arrangement as claimed in claim 8, wherein the fastening members comprise at least two finger-like portions extending into a space between the control fins of the shell.

17. An arrangement as claimed in claim 1, wherein the fastening members comprise at least two finger-like portions extending into a space between the control fins of the shell.

18. An arrangement as claimed in claim 17, wherein the support element is provided with finger-like fastening members numerically in such a manner than during fastening, two finger-like fastening members extend between two adjacent control fins of the shell.

19. A support element for supporting a shell into the barrel of a breech-loading weapon, the support element comprising a rim flange, means for fastening the support element to the tail of the shell, and firing means for firing an actual primer of the shell for firing the shell, wherein the means for fastening the support element to the shell tail are arranged in the support element by means of fastening members settling onto the shell tail tube and arranged to constitute an interference fit between the shell and the support element when the shell is placed in the support element.

20. A method of supporting a shell into the barrel of a breech-loading weapon, in which method a support element is fastened to a tail of a shell, the support element comprising a rim flange, means for fastening the support element to the tail of the shell, and firing means for firing an actual primer of the shell for firing the shell, by using a support element in the fastening, wherein means for fastening the support element to the shell tail are provided in the support element by means of fastening members settling onto the tail tube of the shell, and arranging an interference fit between the shell and the support element by pushing the tail tube of the shell and the support element towards one another.

* * * * *